United States Patent [19]

Hue et al.

[11] Patent Number: 4,850,609

[45] Date of Patent: Jul. 25, 1989

[54] CROSS SHAPED SUPPORT

[75] Inventors: Jean Hue, St. Jorioz; Gerard Graillat; Denis Gasquet, both of Annecy, all of France

[73] Assignee: Salomon S.A., Annecy, France

[21] Appl. No.: 945,572

[22] Filed: Dec. 23, 1986

[30] Foreign Application Priority Data

Mar. 13, 1986 [FR] France ..... 86 03599

[51] Int. Cl.[4] ..... A63C 11/16

[52] U.S. Cl. ..... 280/615; 280/607

[58] Field of Search ..... 280/614, 615, 607, 611

[56] References Cited

U.S. PATENT DOCUMENTS 4,188,044 2/1980 Kautzky .

FOREIGN PATENT DOCUMENTS 0368368 10/1982 Austria .
0370335 3/1983 Austria .
1140959 8/1983 Canada .
0115595 8/1984 European Pat. Off. .
1453107 12/1968 Fed. Rep. of Germany .
2807279 8/1979 Fed. Rep. of Germany .
3115618 3/1982 Fed. Rep. of Germany ..... 280/615
1435195 6/1966 France .
2092844 1/1972 France .
2240751 3/1975 France .
2380795 9/1978 France .
2443853 7/1980 France .
2450618 10/1980 France .
2565117 12/1985 France .
8408713 12/1985 France .
8408714 12/1985 France .
82/03559 10/1982 PCT Int'l Appl. .
124369 1/1928 Switzerland .

*Primary Examiner*—Charles A. Marmor
*Assistant Examiner*—Michael Mar
*Attorney, Agent, or Firm*—Sandler & Greenblum

[57] ABSTRACT

A lateral guidance and support apparatus for a ski boot attached, at its front end, to a cross-country ski, whose heel is free to be displaced at least vertically with respect to the ski. The apparatus includes a longitudinally extending retention rib positioned at the upper surface of the ski which is adapted to engage a longitudinally extending groove in the sole of the boot having substantially the same cross-sectional configuration as the rib. The groove progressively covers the rib when the boot is flattening on the ski. Also provided are one or more projections extending laterally from the rib. These projections are positioned under a support zone of the boot when the boot is attached to the binding and when the grooves in the boot engage the rib on the ski. The support zone of the boot is that portion of the boot positioned under the metatarsus of the foot or positioned under a region of the foot in front of the metatarses. As a result of this structure the rib guides the boot from the beginning of the gait of the foot, thereby increasing the precision and effectiveness of cross-country skiing.

34 Claims, 5 Drawing Sheets

CROSS SHAPED SUPPORT

BACKGROUND OF THE INVENTION

1. Field of the Invention

The present invention relates to a lateral guidance and support apparatus of a ski shoe or boot which is attached at its front end to a cross-country ski and whose heel is free to be displaced at least vertically. In addition, the present invention relates to a cross-country ski which assures such lateral guidance, and to a ski boot which is adapted to engage such a lateral guidance and support apparatus.

2. Description of Background Materials

Various apparatus are known which laterally guide and retain a cross-country ski shoe or boot on a ski. Some of these apparatus comprise a longitudinal guidance rib which is adapted to engage a groove of the same configuration provided in the sole of the shoe. This arrangement assures the lateral guidance and retention of the boot during the gait of the foot, i.e., when the shoe or boot is flattened on the ski. In addition, this longitudinally extending guidance or centering rib can extend the length of the plantar support zone of the foot. Such a guidance apparatus is described, for example, in French Pat. No. 84 08 714 in the name of Applicant.

As described in this French Patent, the guidance rib comprises a projection which extends laterally from the rib. The projection is positioned directly beneath the plantar arch of the foot when the shoe is flattened on the ski. As a result, this projection does not contribute to the lateral guidance or retention of the shoe during the greater portion of the gait, which is disadvantageous, even though it laterally maintains the shoe on the ski when the shoe is flattened on the ski.

Thus, there is a need for a lateral guidance apparatus which laterally retains and guides the boot on the ski during a greater portion of the gait of the skier.

SUMMARY OF THE INVENTION

It is an object of the present invention to provide lateral guidance apparatus which laterally retains and guides a ski boot on a ski during a large portion of the gait of the skier.

An apparatus which achieves this objective relates to a lateral guidance and support apparatus for a ski boot attached at its front end to a cross-country ski by a binding such that the heel of the boot is displaceable at least vertically with respect to the ski. The boot is adapted to hold a foot therein, and the foot comprises a metatarsus. The boot comprises a support zone positioned underneath at least one of the following regions of the foot when the foot is placed in the boot: the metatarsus of the foot, and a region in front of the metatarsus of the foot. The apparatus comprises a longitudinally extending guidance element positioned on the upper portion of the ski. The element comprises means for engaging a longitudinally extending groove in the sole of the boot having substantially the same cross-section as the element. In addition, the apparatus further comprises at least one lateral support projection extending laterally from the element and comprising means for engaging and being covered by a corresponding groove in the sole of the boot. The support projection is positioned under the support zone of the boot when the boot is attached to the binding and the grooves in the boot engage the element and the support projection.

In addition, the invention is directed to this apparatus both in combination with the boot and in combination with the ski. Also, the corresponding groove defined above can have substantially the same shape as the support projection, and the longitudinal groove defined above comprises means for progressively covering the element in response to flattening the boot on the ski.

The support zone of the boot is positioned beneath the metatarsus of the foot and beneath the region in front of the matatarsus of the foot when the foot is placed in the boot. The support projection is positioned under the support zone of the boot and under the metatarsus and under the region in front of the metatarsus when the boot is attached to the binding and the grooves in the boot engage the element and the support projection.

In another embodiment the invention is directed to the apparatus defined above in combination with the ski. In this embodiment the ski comprises the lateral guidance and support apparatus.

In one embodiment the element comprises a longitudinally extending guidance and retention rib. The rib comprises means for being progressively covered by the groove in response to flattening of the boot on the ski. The rib comprises a central longitudinally extending rib. In addition, the apparatus further comprises two lateral support projections, each of which is positioned on a different side of the central longitudinally extending rib and under the support zone. The combination of the rib with the lateral support projections can have substantially the shape of a cross. Also, the two lateral support projections are aligned along an axis substantially tranverse to and substantially perpendicular to the longitudinal axis of the ski. Alternatively, the two lateral support projections are aligned along an axis inclined at an angle other than ninety degrees with respect to the longitudinal axis of the ski.

In one embodiment different lateral support projections are positioned on opposite sides of the rib. In this embodiment the two lateral support projections are offset from each other in the longitudinal direction of the ski. In another embodiment in which the ski comprises interior and exterior lateral sides, one of the lateral support projections comprises an interior lateral support projection extending from the rib toward the interior lateral side of the ski, and the other of the lateral support projections comprises an exterior lateral support projection extending from the rib toward the exterior lateral side of the ski. In this embodiment the interior lateral support projection is positioned in front of the exterior lateral support projection. Alternatively, the interior lateral support projection is positioned behind the exterior lateral support projection.

In one embodiment the rib and the at least one lateral support projection form a single unitary piece with the ski, whereas in an alternative embodiment the rib and the at least one lateral support projection comprise means separate from the ski and mean for being attached to the ski. In an alternative embodiment one of the rib and the at least one lateral support projection comprise means separate from the ski and for being attached to the ski. In this embodiment, for example the at least one lateral support projection can comprise a plurality of wedges comprising means for adjusting the longitudinal position of the plurality of wedges on the ski as a function of the size of the boot.

In still another embodiment the at least one lateral support surface and the rib comprise horizontal upper surfaces, and the horizontal upper surfaces are positioned in the same plane. Alternatively, the height of the at least one lateral support projection is different than the height of the rib.

In another embodiment the ski comprises a lateral side, and the at least one lateral support projection extends from the rib to the lateral side of the ski. Alternatively, the at least one lateral support projection can extend from the rib to a position spaced from the lateral side of the ski.

In still another embodiment in which the invention relates to the apparatus defined above in combination with the boot, the depth of the grooves is substantially equal to the height of the rib and the at least one lateral support projection. Alternatively, the the depth of the grooves can be less than the height of the rib and the at least one lateral support projection. In still another embodiment the the depth of the longitudinally extending groove is less than the height of the rib in front of the metatarsus when the foot is placed in the boot.

In still another embodiment in which the binding is positioned on the ski, and in which the rib and ski comprise a front end and two lateral sides, the at least one lateral projection comprises the front end of the rib and extends laterally from each lateral side of the rib to each lateral side of the ski. Also, the at least one lateral projection comprises a front end adjacent to the binding.

In one embodiment the at least one projection is substantially rectangular. In still another embodiment the at least one projection is substantially in the shape of a parallelogram.

In still another embodiment in which the invention relates to the apparatus defined above in combination with the boot. The boot comprises a sole comprising the support zone. The sole comprises the longitudinally extending groove and the corresponding groove defined above. The corresponding groove comprises means for covering the at least one lateral support projection in response to flattening the boot on the ski.

In still another embodiment in which the invention relates to the apparatus defined above in combination with the ski, the ski comprises the guidance and support apparatus defined above. As a result, the ski comprises the rib and the at least one lateral support projection extending from the rib. Also the ski comprises the projection which is positioned under one of the following regions when the foot is placed in the boot and when the boot is attached to the binding. The regions comprise: the metatarsus and the region in front of the metatarsus.

In still another embodiment the invention relates to a cross-country ski on which the foot of a skier is adapted to be attached by a binding on the ski. The foot comprises a metatarsus and a region in front of the metatarsus. The ski comprises a lateral guidance and support apparatus comprising a longitudinally extending element, and at least one lateral projection extending from the element and positioned under at least one of the following regions when the foot is placed in the boot and the boot is attached to the ski by the binding. The regions comprise the metatarsus and the region in front of the metatarsus.

BRIEF DESCRIPTION OF THE DRAWINGS

The invention will now be described by way of non-limiting example only in the detailed description which follows with reference to the attached drawings in which:

FIG. 9 illustrates two alternative embodiments for the supports which are shown respectively in the left and right portions of FIG. 9;

DESCRIPTION OF PREFERRED EMBODIMENTS

Figure 1:
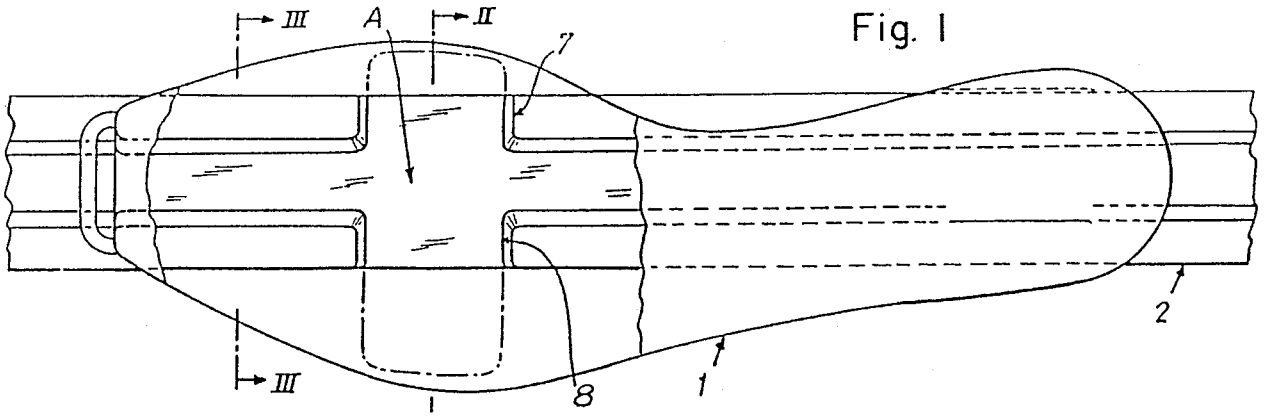
FIG. 1 is a planar view, partially broken away, of a cross-country ski shoe or boot guided on the ski by means of a lateral guidance and support apparatus of the present invention.

The present invention relates to improvements in lateral guidance apparatus for laterally retaining a ski boot on a ski so as to increase the contact surface between the shoe and the ski from the beginning of the gait of the foot, so as to thus increase the precision and efficacy of the retention and the guiding of the boot on the ski.

To accomplish this goal the present invention relates to a lateral guidance and support apparatus for a ski shoe attached at its front end to a cross-country ski and whose heel is free to be displaced at least vertically. The apparatus comprises a longitudinally extending guidance rib positioned at the upper portion of the ski, and a longitudinally extending groove positioned in the sole of the shoe. The groove has substantially the same cross-sectional shape as the guidance rib, and the groove progressively caps this rib in the course of the flattening of the foot and the boot on the ski. The guidance rib further comprises one or more support projections extending laterally from the rib so as to comprise a lateral cross. Further, the sole of the boot also comprises a corresponding groove which forms with the longitudinal groove a corresponding cross. The lateral projection of the longitudinal guidance rib is positioned in the support zone of the metatarses of the foot or in front of the support zone of the matatarses.

According to a first embodiment of the present invention the lateral guidance and support apparatus comprises a longitudinal central rib and two lateral projections disposed, respectively, on both sides of the longitudinal central rib. The rib has the shape of a cross in this support zone. The two lateral projections can be aligned along a substantially transverse axis, i.e., substantially perpendicular to the longitudinal axis of the ski. Alternatively, the two lateral projections can be aligned along an axis which is inclined with respect to the longitudinal axis of the ski.

The longitudinal rib and the lateral projection or projections can form a single unitary piece with the ski itself or can comprise elements separate from the ski which are adapted to be attached to the ski.

FIGS. 1–5 show a first embodiment of a lateral guidance and support apparatus for laterally guiding and retaining a cross-country ski shoe or boot 1 on a cross-country ski 2. Shoe 1 is attached in the normal manner, at its front end, to ski 2, by means of a binding apparatus which is not shown, of any appropriate type, such that the heel is adapted to be lifted with respect to the ski during cross-country skiing.

The lateral guidance and support apparatus of the present invention comprises a longitudinally extending rib 3 which extends substantially parallel to the longitudinal axis of the ski. Rib 3 is positioned on the upper surface of the ski, at least in the zone in which shoe 1 rests. Rib 3 can have any appropriate cross-sectional shape, for example, a trapezoidal cross-section such as is shown in FIGS. 1–5. Rib 3 can also be centered or offset with respect to the longitudinal plane of symmetry of the ski, and rib 3 can have a constant cross-sectional area or a cross-sectional area which varies in the longitudinal direction of the ski. In addition rib 3 can be integral with the ski, rib 3 can be formed as a unitary piece with the ski, or rib 3 can be a separate element which is adapted to be attached to the upper surface or portion of the ski.

Figure 6:
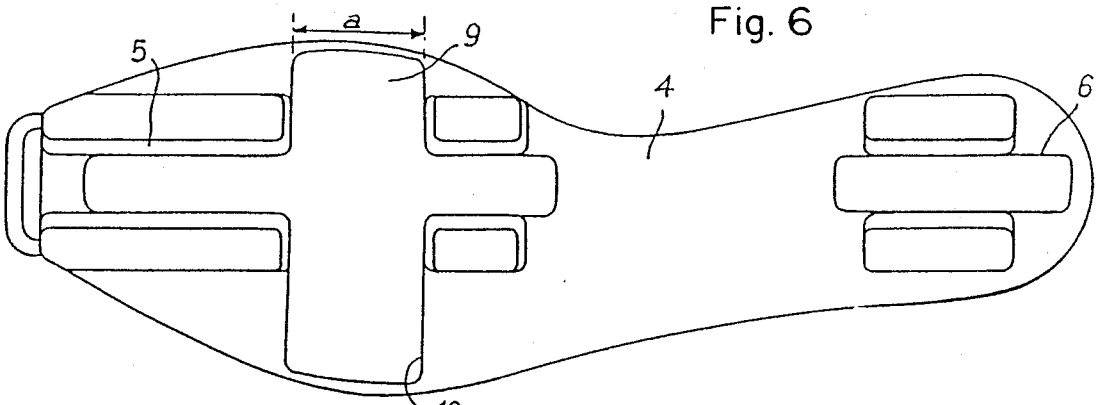
FIG. 6 is a bottom view of a cross-country ski shoe adapted to engage a cross-country ski such as that shown in FIG. 4.

In the embodiment shown in FIGS. 1–5 longitudinally extending rib 3 is integral with and forms one unitary piece with ski 2. Rib 3 is adapted to be capped or covered by corresponding grooves provided in a sole 4 of the shoe, as illustrated in FIG. 6. These grooves can comprise a continuous groove or these grooves can comprise, as shown in FIG. 6, a longitudinally extending anterior groove 5 extending in the support zone of the metatarsus, and a longitudinally extending posterior groove 6 extending in the zone of the heel. Grooves 5 and 6 are longitudinally aligned and are spaced apart from one another.

Figure 4:
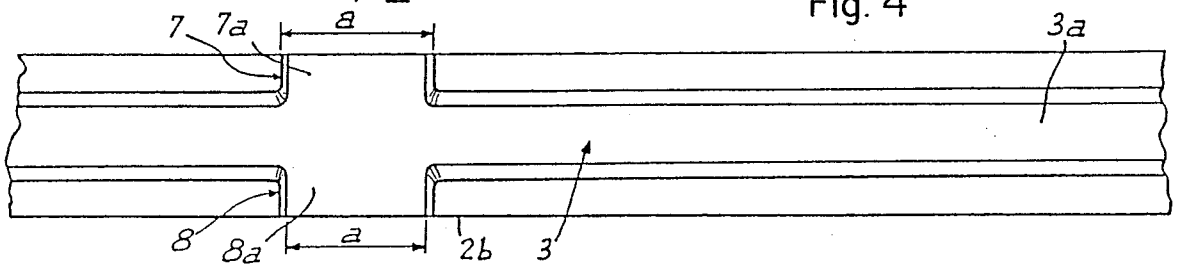
FIG. 4 is a partial planar view of a cross-country ski provided with a guidance and support rib in the shape of a cross.

Rib 3 also comprises at least one lateral support projection extending laterally from rib 3 and across a distance "a" along the longitudinal axis of the ski, as is illustrated in FIG. 4. That portion of rib 3 and the projection that extend over this distance "a" is called zone A, as is illustrated in FIG. 1. Zone A of the rib corresponds to a support zone "a" of the boot, illustrated in FIG. 6. The support zone of the boot is defined as that portion of the sole of the boot which is beneath the metatarsus region of the foot and/or beneath the region of the foot in front of the metatarsus. The at least one lateral support projection is integral with and unitary with the ski, in a manner similar to or identical to rib 3.

In the embodiment illustrated in FIGS. 1–5 the lateral guidance and support apparatus comprises two lateral support projections 7 and 8 of substantially rectangular configuration which, in this embodiment, extend to lateral sides 2*a* and 2*b* of ski 2. Upper horizontal surfaces 7*a* and 8*a* of lateral projections 7 and 8 are positioned in this embodiment in the same plane as upper horizontal surface 3*a* of rib 3. In addition, lateral projections 7 and 8 are aligned along a same single transverse axis, and rib 3 and projections 7 and 8 together form a cross-shaped element.

Furthermore, sole 4 of the shoe is configured in such a manner so as to comprise lateral grooves 9 and 10 that are transversely aligned and which open into central anterior longitudinally extending groove 5. Lateral grooves 9 and 10 are adapted to respectively cap or cover lateral projections 7 and 8 when the shoe is completely flattened on ski 2. The depth of each lateral groove 9 and 10 and of the central zone of guidance groove 5, which is that portion of groove 5 positioned between grooves 9 and 10, is selected to be such that the bottoms of grooves 9, 10 and of groove 5 are flattened on upper horizontal surfaces 7*a*, 8*a* and 3*a* respectively of lateral projections 7, 8 and of guidance rib 3.

Figure 3:
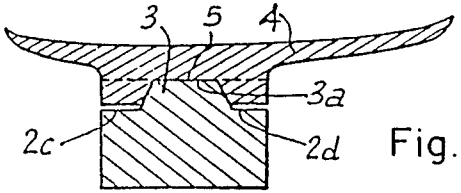
FIG. 3 is a tranverse cross-sectional view taken along line III—III of FIG. 1.
Figure 2:
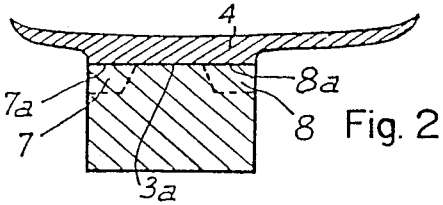
FIG. 2 is a tranverse cross-sectional view taken along line II—II of FIG. 1.

In front of support zone "a", groove 5 can have a depth less than the height of guidance rib 3 so in such a manner that the extreme anterior portion of sole 4 is only supported by the bottom of groove 5 on upper horizontal surface 3*a* of rib 3, as can be seen in FIG. 3.

In the shaded portion of FIG. 1 the anterior portion of zone A, corresponding to the support zone of sole 4, is shown when the shoe is flattened on the ski. Support zone A of the lateral guidance and support apparatus comprises a portion of upper surface 3*a* of rib 3 and upper surfaces 7*a* and 8*a* of lateral projections 7 and 8. As a result, by virtue of the use of lateral projections 7 and 8, the anterior portion of sole 4 of shoe 1 is perfectly maintained on ski 2, at the end of the gait of the foot.

Figure 5A:
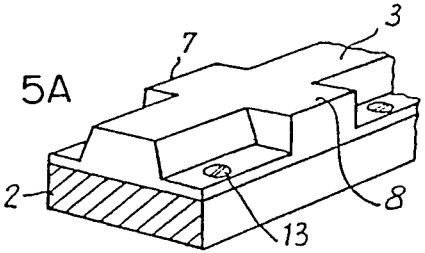
FIG. 5A is a perspective view similar to that of FIG. 5, showing an alternative embodiment of the rib of the present invention.

In the alternative embodiment illustrated in FIG. 5A the guidance and support apparatus comprising rib 3 and two lateral projections 7 and 8, forms an assembly independent from ski 2, which is attached to the upper surface of the ski by any appropriate means such as, for example, screws 13.

Figure 7:
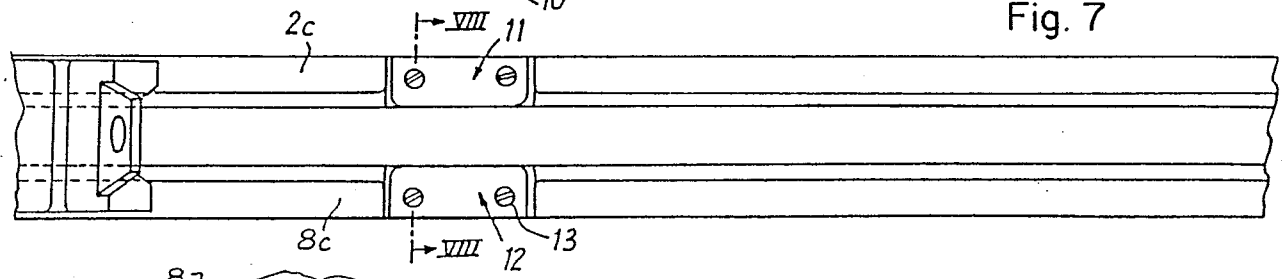
FIG. 7 is a planar view of an alternative embodiment of a guidance apparatus of the present invention.
Figure 8:
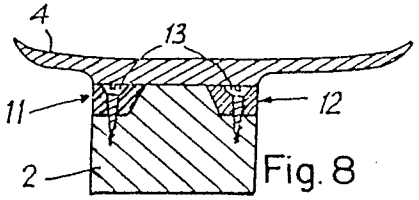
FIG. 8 is a vertical and transverse cross-sectional view taken along line VIII—VIII of FIG. 7, with a shoe supported on the ski.
Figure 5:
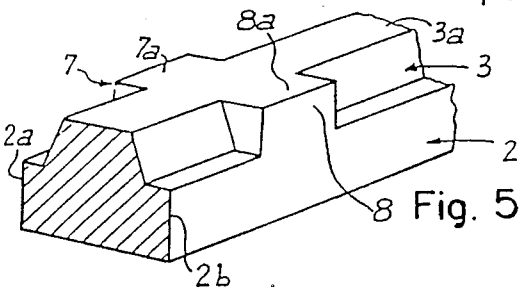
FIG. 5 is a partial perspective view of the guidance and support rib illustrated in FIG. 4.

In the alternative embodiment illustrated in FIGS. 7 and 8 the lateral guidance and support apparatus comprises two lateral projections 11, 12 which comprise elements or wedges which are separate and independent of ski 1, and which are adapted to be attached to upper horizontal surface 2*c* of ski 2, by means of screws 13. The position of wedges 11, 12 is adapted to be adjusted in the longitudinal direction of the ski as a function of the size of the shoe used, in a manner so as to be adapted to be capped exactly by the lateral grooves 9 and 10 which are provided in the sole of the shoe.

Figure 9:
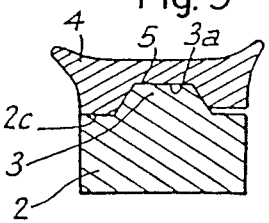
FIG. 9 is a vertical cross-sectional and transverse view of a shoe supported on the cross-country ski, in the zone positioned in front of the support zone of the metatarsus.

FIG. 9 illustrates two different ways in which the anterior portion of sole 4 can be supported on the anterior portion of the ski. The left portion of FIG. 9 illustrates one embodiment in which the depth of groove 5 is substantially equal to the height of rib 3. As a result, the sole is supported both on upper horizontal surface 3*a* of rib 3 as well as on upper horizontal surface 2*c* of ski 2, on both sides of rib 3. The right portion of FIG. 9 illustrates an embodiment in which the depth of groove 5 is less than the height of rib 3 and sole 4 is simply supported on upper horizontal surface 3*a* of guidance rib 3 by the bottom of groove 5. As a result, a space is provided between the horizontal surface 2*c* of ski 2 and the lower surface of each lateral portion of sole 4.

Figure 12:
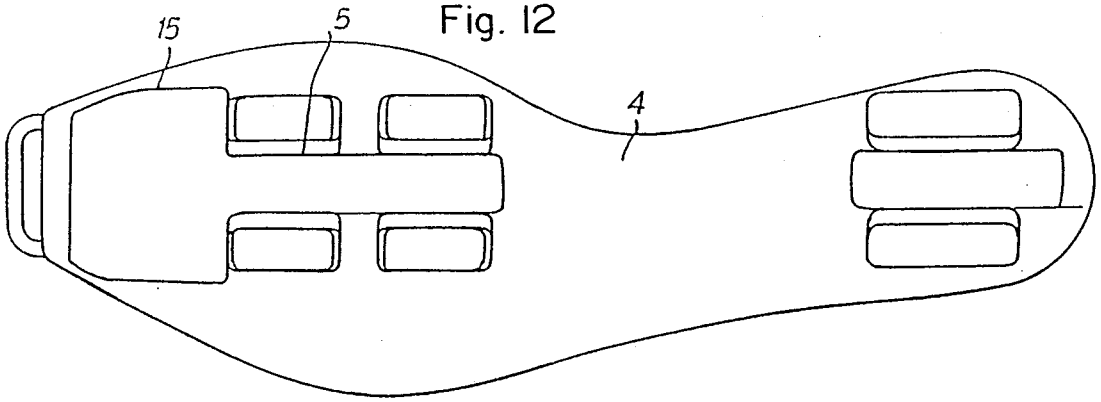
FIG. 12 is a bottom view of a cross-country ski shoe adapted to engage the guidance and support apparatus illustrated in FIG. 10.
Figure 10:
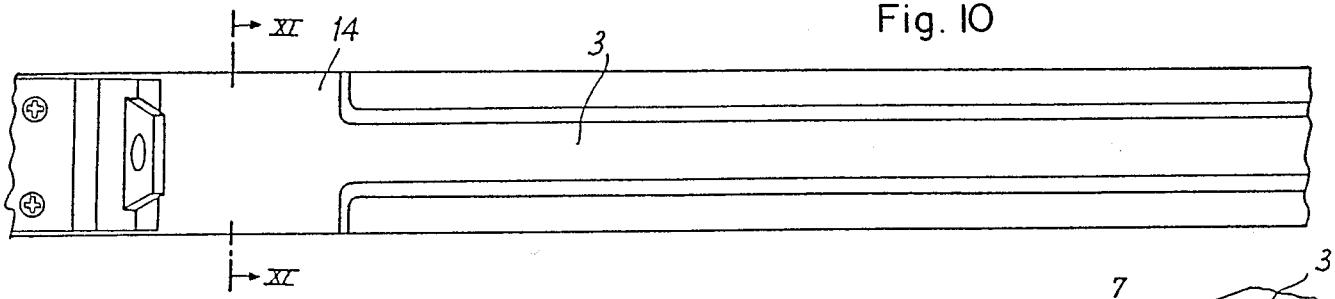
FIG. 10 is a planar view of an alternative embodiment of a guidance and support apparatus of the present invention provided on the cross-country ski.
Figure 11:
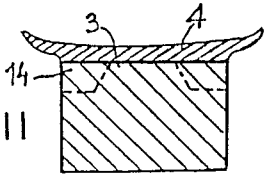
FIG. 11 is a vertical and transverse cross-sectional view taken along line XI—XI of FIG. 10, a shoe being supported on the ski.

FIGS. 10–12 illustrate an alternative embodiment in which the front end of guidance rib 3 is positioned close to or substantially adjacent to the apparatus for attaching the shoe to the ski. As illustrated in these figures, the front end of rib 3 comprises a single projection 14 extending over the entire width of the ski to each lateral side 2*a* and 2*b* of ski 2. This single projection 14 is adapted to be covered or capped by a single correspondingly shaped groove 15 provided in the lower surface of sole 4. Groove 15 opens onto longitudinally extending groove 5, as illustrated in FIG. 12. This embodiment of the lateral guidance and support apparatus offers the advantage that a single projection 14 can be used with shoes of different sizes because it is adapted to be capped or covered by a groove 15 which is always positioned at the front end of sole 4, regardless of the size of the boot.

Figure 13:
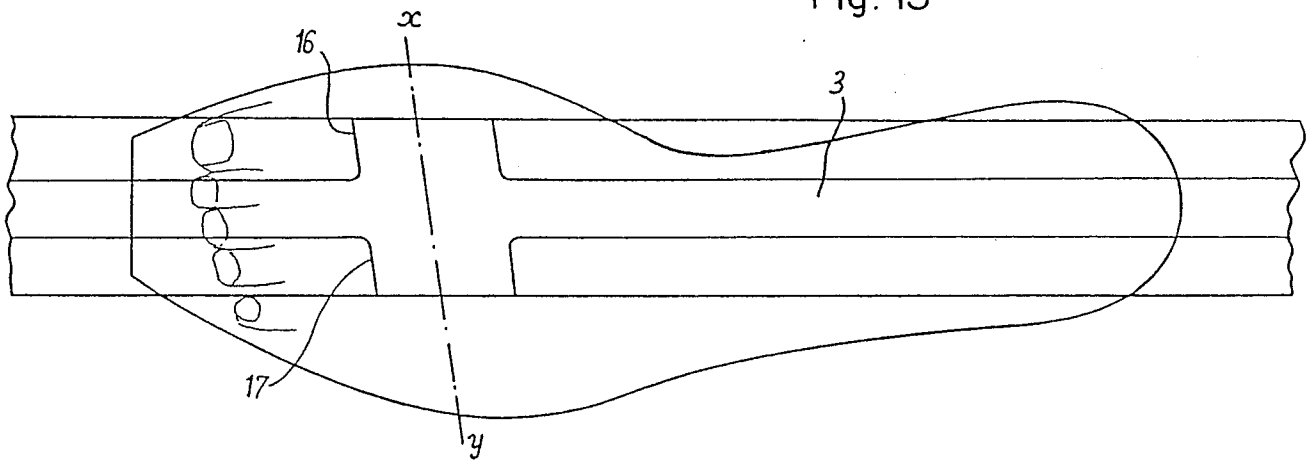
FIG. 13 is a planar view of another embodiment of a guidance and support apparatus of the present invention.

In the embodiment of the invention shown in FIG. 13 two lateral projections 16 and 17 are substantially in the form of parallelograms, and are substantially aligned along the xy axis, which is inclined with respect to the longitudinal axis of the longitudinal rib of guidance rib 3, by an angle other than 90°.

Figure 14:
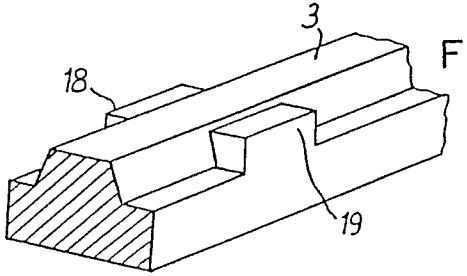
FIG. 14 is a perspective view of another alternative embodiment of the guidance and support apparatus of the present invention.

In the embodiment shown in FIG. 14 two lateral projections 18 and 19 have heights that are different from the height of guidance rib 3. For example, projection 18 and 19 can have heights which are less than the height of rib 3, as is illustrated in FIG. 14, or projections 18 and 19 can have heights that are greater than the height of rib 3.

Figure 15:
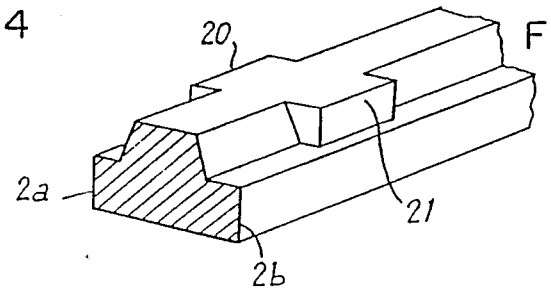
FIG. 15 is a perspective view of another embodiment of the guidance and support apparatus of the present invention.

In the embodiment shown in FIG. 15 lateral projections 20 and 21 end at a distance from lateral sides 2*a* and 2*b* of ski 2.

Figure 17:
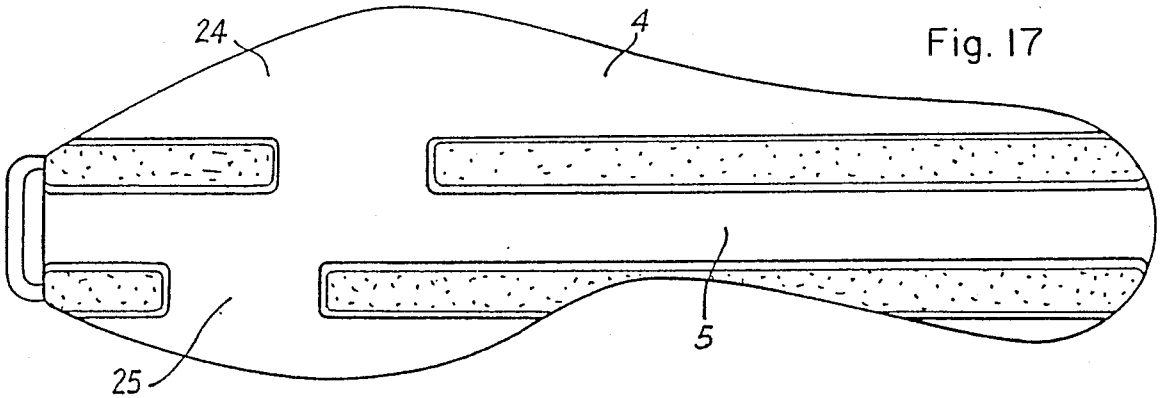
FIG. 17 is a bottom view of a cross-country ski shoe adapted to engage the guidance and support apparatus shown in FIG. 16.
Figure 16:
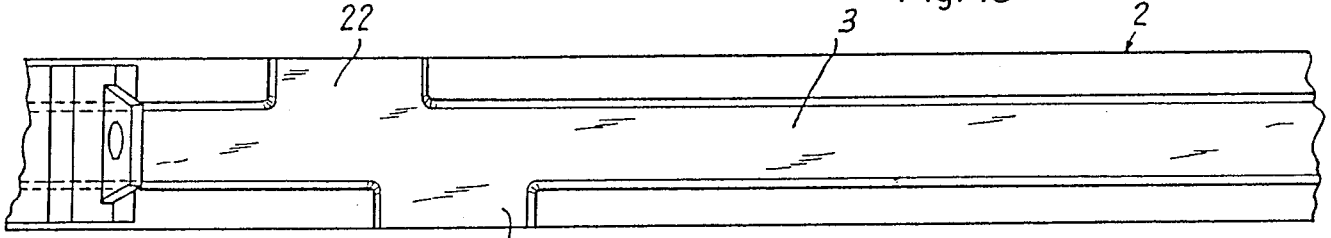
FIG. 16 is a planar view of an alternative embodiment of the guidance and support apparatus of the present invention on a cross-country ski.
Figure 19:
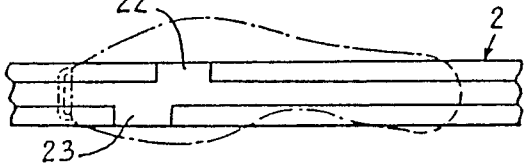
FIGS. 18 and 19 are schematic views illustrating the position of the shoe of the skier with respect to two different embodiments of the the guidance and support apparatus of the present invention in which the lateral support projections are positioned in two different and opposite positions.
Figure 18:
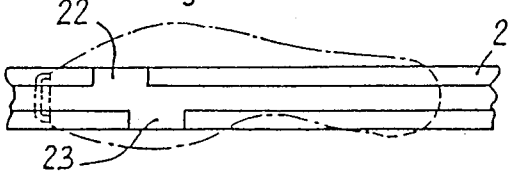

In the embodiment shown in FIGS. 16–19 two lateral projections 22 and 23 are positioned on both sides of longitudinal central rib 3 and are longitudinally offset with respect to one another. Lateral projections 22, which is positioned on the exterior side of ski 2 can be positioned in front of other lateral projection 23, which is positioned on the interior side of the ski, as is shown in FIGS. 16 and 18. It is also within in the scope of the invention to provide for the reverse arrangement, as is shown in FIG. 19. In this embodiment lateral projection 22, positioned on the exterior side of the ski, is offset behind projection 23, positioned on interior side of the ski. In these embodiments longitudinal central rib 3 and two lateral projections 22, 23 can either form a single unitary or integral element with ski 2, or these elements can comprise as assembly separate from the the ski and adapted to be attached to the ski.

In addition, in these embodiments, sole 4 of the shoe is configured, as is shown in FIG. 17, in a manner so as to provide, besides longitudinal central groove 5, two lateral grooves 24, 25 which are longitudinally offset with respect to one another and are adapted to respectively cap or cover lateral projections 22, 23 when the boot is completely flattened on ski 2.

Although the invention has been described with respect to particular means, materials and embodiments, it is to be understoood that the invention is not limited to the particulars disclosed and extends to all equivalents within the scope of the claims.

What is claimed is:

1. A guidance and support apparatus for a ski boot including a sole, said guidance and support apparatus having a lateral support zone positioned underneath at least one region of the foot of the skier, said lateral support zone selected from the group consisting of the metatarsus region of said foot and a region in front of said metatarsus region of said foot, said boot being attached at its front end to a cross-country ski by a binding such that the heel of said boot is displaceable at least vertically with respect to said ski, said apparatus comprising:

a longitudinally extending guidance element adapted to be positioned on an upper portion of a ski equipped with a binding, said ski having a pair of lateral sides, wherein said guidance element comprises a substantially planar upper surface, and further comprises means for engaging a longitudinal groove in said sole of said boot having a cross-section substantially the same as a cross-section of said guidance element; and a lateral support projection extending laterally from each lateral side of said longitudinally extending guidance element and comprising a means for engaging and being covered by a corresponding lateral groove in said sole, each said lateral support projections having a substantially planar upper surface extending toward a respective one of said pair of said lateral sides of said ski, wherein said upper surface of each said lateral support projection includes a pair of substantially parallel upper edges, and wherein at least one said lateral support projection is positioned under said lateral support zone of said boot when said boot is attached to said binding and each said longitudinal groove and lateral groove in said sole engage said longitudinally extending guidance element and a respective one of said lateral support projections.

2. The apparatus defined by claim 1 in combination with said boot.

3. The apparatus defined by claim 2 in combination with said ski.

4. The apparatus defined by claim 2 wherein each said corresponding lateral groove in said sole has substantially the same shape as a respective one of said lateral support projections.

5. The apparatus defined by claim 2 wherein said longitudinal groove in said sole comprises means for progressively covering said element in response to flattening said boot on said ski.

6. The apparatus defined by claim 5 wherein said support zone of said boot is positioned beneath the metatarsus of said foot and beneath said region in front of said metatarsus of said foot when said foot is placed in said boot, wherein each said lateral support projection is positioned under said support zone of said boot and under said metatarsus and under said region in front of said metatarsus when said boot is attached to said binding and said grooves in said boot engage said element and each said lateral support projection.

7. The apparatus defined by claim 1 in combination with said ski, wherein said ski comprises said lateral guidance and support apparatus.

8. The apparatus defined by claim 1 wherein said element comprises a longitudinally extending guidance and retention rib.

9. The apparatus defined by claim 8 wherein said rib comprises means for being progressively covered by said longitudingal groove in response to flattening of said boot on said ski.

10. The apparatus defined by claim 9 wherein said rib comprises a central longitudinally extending rib, wherein said apparatus further comprises two lateral support projections, each of which is positioned on a different side of said central longitudinally extending rib and under said support zone, wherein the combination of said rib with said lateral support projections has substantially the shape of a cross.

11. The apparatus defined by claim 10 wherein said two lateral support projections are aligned along an axis substantially transverse to and substantially perpendicular to the longitudinal axis of said ski.

12. The apparatus defined by claim 10 wherein said two lateral support projections are aligned along an axis inclined at an angle other than ninety degrees with respect to the longitudinal axis of said ski.

13. The apparatus defined by claim 9 further comprising two lateral support projections, different lateral support projections positioned on opposite sides of said rib, wherein said two lateral support projections are offset from each other in the longitudinal direction of said ski.

14. The apparatus defined by claim 13 wherein said ski comprises interior and exterior lateral sides, wherein one of said lateral support projections comprises an interior lateral support projection extending from said rib toward said interior lateral side of said ski, wherein the other of said lateral support projections comprises an exterior lateral support projection extending from said rib toward said exterior lateral side of said ski, wherein said interior lateral support projection is positioned in front of said exterior lateral support projection.

15. The apparatus defined by claim 13 wherein said ski comprises interior and exterior lateral sides, wherein one of said lateral support projections comprises an interior lateral support projection extending from said rib toward said interior lateral side of said ski, wherein the other of said lateral support projections comprises an exterior lateral support projection extending from said rib toward said exterior lateral side of said ski, wherein said interior lateral support projection is positioned behind said exterior lateral support projection.

16. The apparatus defined by claim 9 wherein said rib and each said lateral support projection form a single unitary piece with said ski.

17. The apparatus defined by claim 9 wherein said rib and each said lateral support projection comprises means for being attached to said ski.

18. The apparatus defined by claim 9 wherein one of said rib and each said lateral support projection comprises means separate from said ski and means for being attached to said ski.

19. The apparatus defined by claim 18 wherein each said lateral support projection comprises a plurality of wedges comprising means separate from said ski for adjusting the longitudinal position of said plurality of wedges on said ski as a function of the size of said boot.

20. The apparatus defined by claim 9 wherein each said lateral support projection and said rib comprise horizontal upper surfaces positioned in a same plane.

21. The apparatus defined by claim 9 wherein the height of each said lateral support projection is different than the height of said rib.

22. The apparatus defined by claim 9 wherein said ski comprises lateral sides, and each said lateral support projection extends from said rib to one of said lateral sides of said ski.

23. The apparatus defined by claim 9 wherein said ski comprises lateral sides, and each said lateral support projection extends from said rib to a position spaced from one of said lateral sides of said ski.

24. The apparatus defined by claim 9 in combination with said boot, wherein the depth of said grooves is substantially equal to the height of said rib and each said lateral support projection.

25. The apparatus defined by claim 9 in combination with said boot, wherein the depth of said grooves is less than the height of said rib and each said lateral support projection.

26. The apparatus defined by claim 9 in combination with said boot, wherein the depth of said longitudinally extending groove is less than the height of said rib in front of said metatarsus when said foot is placed in said boot.

27. The apparatus defined by claim 9 wherein said binding is positioned on said ski, wherein said rib comprises a front end and two lateral sides, wherein said ski comprises two lateral sides, wherein each said lateral projection comprises said front end of said rib and extends laterally from a respective lateral side of said rib to each lateral side of said ski, wherein each said lateral support projection comprises a front end adjacent to said binding.

28. The apparatus defined by claim 9 wherein each said lateral support projection is substantially rectangular.

29. The apparatus defined by claim 28 wherein each said lateral support projection is substantially in the shape of a parallelogram.

30. The apparatus defined by claim 9 in combination with said boot, wherein said sole of said boot comprises said support zone, said longitudinal groove and said lateral groove, said lateral groove comprising means for covering each said lateral support projection when said boot is flat on said ski.

31. The apparatus defined by claim 9 in combination with said ski, wherein said ski comprises said lateral guidance and support apparatus comprising said rib and each said lateral support projection extending from said rib, wherein each said lateral support projection is positioned under a region of the front selected from the metatarsus and a region in front of the metatarsus placed in said boot when said boot is attached to said binding.

32. A guidance and support apparatus for a ski boot including a sole, said guidance and support apparatus having a lateral support zone positioned underneath substantially only the metatarsus region of the foot, attached at its front end to a cross-country ski by a binding such that the heel of said boot is displaceable at least vertically with respect to said ski, said apparatus comprising:

a longitudinally extending guidance element adapted to be positioned on an upper portion of a ski equipped with a binding, said ski having a pair of lateral sides, wherein said guidance element comprises a pair of longitudinally extending lateral side surfaces, a substantially planar upper surface, and further comprises means for engaging a longitudinal groove in said sole of said boot, said longitudinal groove having a cross-section substantially the same as a cross-section of said guidance element; and a single lateral support projection extending laterally from each side of said longitudinally extending guidance element and extending substantially to a respective side surface of said ski, said lateral support projections further comprising respective substantially planaar upper surfaces and a means for engaging and being covered by a corresponding lateral groove in said sole, wherein at least one of said lateral support projections is positioned solely under said lateral support zone of said boot when said boot is attached to said binding, and each said longitudinal groove and lateral groove in said sole engage said guidance element and said lateral support projections.

33. A cross-country ski adapted to be attached to a boot by a binding on said ski, said ski having a pair of lateral sides and comprising a lateral guidance and support apparatus comprising:

a longitudinally extending element positioned on an upper portion of said ski, wherein said longitudinally extending guidance element comprises a pair of longitudinally extending lateral side surfaces, a substantially planar upper surface, and further comprises means for engaging a longitudinal groove in a sole of a boot, said longitudinal groove having a cross-section substantially the same as a cross-section of said guidance element; and a single lateral projection extending from each side of said longitudinally extending element and extending substantially to a respective side surface of said ski, wherein each said lateral projection comprises a pair of lateral side surfaces and a substantially planar upper surface, and further comprises means for engaging a correspondingly shaped lateral groove in said sole of said boot, and wherein at least one of said lateral support projections is positioned under substantially only the metatarsus region of a foot in said boot.

34. A cross-country ski boot including a heel adapted to be attached at its front end to a cross-country ski by a binding such that the heel of said boot is displaceable at least vertically with respect to said ski, said ski having longitudinally extending sides, said boot having a sole and further comprising:

a support zone positioned underneath substantially only the metatarsus region of a foot in said boot;

a longitudinally extending groove in said sole comprising means for covering a longitudinally extending rib on said ski, said longitudinally extending rib having a cross-sectional shape substantially the same as a cross-sectional shape of said longitudinally extending groove when said boot is flat on said ski, said longitudinally extending rib having a pair of longitudinally extending lateral side surfaces and a substantially planar upper surface; and a single groove in said sole extending laterally from each side of said longitudinally extending groove and comprising means for covering lateral support projections extending laterally from said longitudinally extending rib on said ski to substantially either respective side of said ski when said boot is flat on said ski, said lateral support projections having lateral side surfaces and a substantially planar upper surface, wherein at least one of said laterally extending grooves is positioned in said support zone.

* * * * *

UNITED STATES PATENT AND TRADEMARK OFFICE

CERTIFICATE OF CORRECTION

PATENT NO. : 4,850,609

DATED : July 25, 1989

INVENTOR(S) : Jean HUE et al.

It is certified that error appears in the above-identified patent and that said Letters Patent is hereby corrected as shown below:

At column 2, line 35, change "tranverse" to —transverse—.

At column 3, line 17, change "the the" to —the—.

At column 3, line 20, change "the the" to —the—.

At column 4, line 7, change "tranverse" to —transverse—.

At column 4, line 9, change "tranverse" to —transverse—.

At column 4, line 59, change "the the" to —the—.

At column 7, line 61, delete "in" after "within".

At column 8, line 1, change "the the" to —the—.

At column 8, line 1, change "as" to —an—.

At column 10, line 61 (claim 31, line 6), change "front" to —foot—.

At column 11, line 22 (claim 32, line 26), change "planaar" to —planar—.

Signed and Sealed this

Twenty-third Day of July, 1991

*Attest:*

*Attesting Officer*

HARRY F. MANBECK, JR.

*Commissioner of Patents and Trademarks*